US005279246A

United States Patent [19]

Fielder

[11] Patent Number: 5,279,246

[45] Date of Patent: Jan. 18, 1994

[54] DEVICE FOR INTRODUCING WATER INTO LIVEWELLS

[76] Inventor: Mark Fielder, Rte. 1, Box 194-F, Eufaula, Ala. 36027

[21] Appl. No.: 980,648

[22] Filed: Nov. 24, 1992

Related U.S. Application Data

[63] Continuation-in-part of Ser. No. 518,154, May 3, 1990, Pat. No. 5,165,358.

[51] Int. Cl.[5] ..... B63B 35/26

[52] U.S. Cl. ..... 114/255; 43/57; 114/183 R

[58] Field of Search ... 114/183 R, 185, 198; 43/55-57 137/512, 567, 592, 599, 493.8

[56] References Cited

U.S. PATENT DOCUMENTS

| | | | |
|---|---|---|---|
| 3,084,472 | 4/1963 | Felk | 43/55 |
| 4,033,280 | 7/1977 | Wood et al. | 114/255 |
| 4,074,651 | 2/1978 | Arduser | 114/255 |
| 4,832,073 | 5/1989 | Campau | 43/55 |

*Primary Examiner*—Jesûs D. Sotelo

*Attorney, Agent, or Firm*—Deveau, Colton & Marquis

[57] ABSTRACT

A device for collecting water and channelling it into a boat livewell circulation system comprising a housing which comprises a pivotal and/or extendable scoop, an intake channel, and a pressure valve, which housing is secured to a mounting device which comprises an intake port and a connection element to connect the device to a boat livewell circulation system, which device is operable when the boat is running or idle.

16 Claims, 4 Drawing Sheets

DEVICE FOR INTRODUCING WATER INTO LIVEWELLS

CROSS-REFERENCE TO RELATED APPLICATIONS

The present application is a continuation-in-part of copending application Ser. No. 07/518,154 filed on May 3, 1990 now U.S. Pat. No. 5,165,358.

BACKGROUND OF THE INVENTION

1. Field of the Invention

This invention relates generally to a device which is mounted through the transom of a fishing boat and which is extendable extends beyond the bottom of the boat and below the surface of the water so as to deliver water to the livewell circulation system in a preselected quantity of flow rate while the boat is moving through the water, and specifically to a device which is pivotally mounted so as to allow the device to bend when it hits rocks and other debris in the water while the boat is in mounted anywhere on the transom of the boat.

2. Description of the Prior Art

Anglers of all types and skill levels have long known the desirability of keeping the fish they have caught alive for extended periods of time, for example, throughout the fishing day. For the pleasure or food angler, keeping caught fish alive is important in maintaining the freshness of the fish. For the sports angler, keeping caught fish alive generally is a requirement in order to qualify for prize money in fishing contests.

One of the oldest, most well-known and most used method of keeping caught fish alive is to place the caught fish in a net or perforated pail and to submerge the net or pail in the body of water to a depth such that the fish are submerged, and the rim of the net or pail is situated such that the fish cannot escape. A second old, well-known and well-used method of keeping caught fish alive is to string the fish on a wire or cord extending through the fish's mouth and out one of its gills and then to hang the string of fish in the water. Both of these methods are well-suited to static fishing situations; however, when a fisherman desires to quickly moved from one fishing locale to another, the fisherman must take the net or pail or string of fish out of the water, place it in his boat, move to the new locale and then replace the net or pail or string of fish in the water. This is both time consuming and can cause damage to the caught fish.

One method invented to ease the burden of the fisherman in keeping caught fish alive and, at the same time, being mobile is called the "livewell". The basic livewell is a tub or reservoir physically located in the fishing boat. Livewells range from simple solid tubs to complex reservoir systems including hoses and pumps to bring fresh water in from the body of water and overflows through a drain to discharge stale water to the lake. Such positive circulation livewells are the livewells of choice to the sports fisherman.

The basic positive circulation livewell generally includes an intake port generally on the transom of a boat, a hose leading from the intake hole to a pump, a hose leading from the pump to a spray nozzle inside the top of a livewell reservoir, a master drain hose leading from the bottom of the reservoir to an open/close valve and from the valve to the outside of the boat, and an overflow drain leading from the top-side of the reservoir to the outside of the boat. Some drains do not have a valve and a rubber stopper is used to plug the drain inside the reservoir. In operation, when the fishing boat is stationary in the water the intake port on the transom of the boat is below the surface of the water. The pump is turned on and forces the fresh water through the spray nozzle and into the livewell where the caught fish are placed. To keep the water level in the livewell at a certain height, one can close the master drain valve causing the incoming water to rise to the point in which it overflows out of the overflow drain at the top of the reservoir. The pump can remain on until one is ready to drain the system. To drain the system, one opens the master drain valve causing the reservoir water to flow out of the livewell to the outside of the boat.

A disadvantage of the conventional livewell configuration is that such livewell configurations do not operate when the fishing boat is moving at more than a slow speed. When boats begin to move they create a trough behind the boat such that water generally does not come in contact with the rear transom. As the boat picks up speed, the trough is more pronounced and generally water will not come to the level of the intake port. Thus, when the boat is moving the intake port is not submerged and no oxygenated water can be pumped through the system into the livewell. To avoid subjecting the fish to long time periods without fresh oxygenated water, a recirculation system is necessary and generally is added to this livewell configuration. The recirculation system is activated when the boat is moving such that the water in the livewell is recirculated through a series of pumps and hoses back into the livewell. Such recirculation systems aerate the water thus assisting in keeping the fish alive for an extended period of time; however, no fresh water can be introduced to the livewell configuration while the boat is moving.

Two other disadvantages of current livewell circulation configurations involve the mounting of the water intake parts on the transom of the boat. First, current scoops which extend beyond the bottom of the boat may snag on rocks, tree limbs or other materials under the surface of the water, causing damage to the scoop or to the boat. Second, the mounting hole for the livewell intake may be too high on the transom to allow the scoop to extend down to the water level, and no water may be forced into the livewell. It can be seen that there exists a need for an apparatus for introducing water to a livewell which avoids the disadvantages mentioned above.

SUMMARY OF THE INVENTION

Briefly described, the invention comprises a device, namely an intake, which includes a pivotally mounted, extendable scoop means for collecting water and directing it through an optional valve means for regulating the flow of the water into the livewell circulation system. The scoop means allows water to be forced into the livewell circulation system while the boat is moving, as well as extending into the water when the boat is stationary such that a pump may pull water through the invention and into the livewell circulation system. The pivotally mounted scoop allows the scoop to pivot backwards if it comes into contact with underwater debris. The extendable scoop allows the scoop to be adjusted relative to where the device is mounted on the transom such that the scoop always will extend below the bottom of the boat. Thus, fresh water can be circulated throughout the livewell system both when the boat is stationary and when the boat is moving, without fear that the scoop will cause damage to the boat if it snags on underwater debris, or not contact the water.

The invention generally is mounted through the transom of the boat using a thru-transom mounting assembly. The thru-transom mounting assembly is inserted through a previously drilled hole through the transom of the boat. The length of the scoop intake unit is adjustable so as to allow the lower end of the unit to extend below the plane of the bottom surface of the boat such that the lower end of the scoop intake will contact the water under the boat when the boat is moving as well as when the boat is stationary. The pressure valve and pressure valve housing are then mounted onto the thru-transom mount. A screen or various screens are incorporated at strategic points in and/or on the unit to keep debris out of the unit and from entering the circulation system.

In operation, as the boat is being propelled through the water the intake scoop scoops water up into the unit, through the pressure valve and through the thru-transom mount and into the circulation system of the livewell. The pressure valve can be adjusted so as to adjust the flow of the water through the system. The movement of the boat forces fresh water through the scoop intake, through the pressure valve and into the livewell circulation system such that a circulation pump is not necessary when the boat is in motion, although an already present pump can be used to its fullest extent by simply adjusting the pressure valve to create the appropriate flow to the pump. When the boat is stopped, the livewell circulation system pump pumps fresh water from the body of water through the unit, then through the pressure valve and into the livewell circulation system, which comprises a hose, pump, and spray nozzle such that fresh water is continuously supplied to the livewell. The lower end of the intake scoop is pivotally attached to the pressure valve housing so as to allow the intake scoop to bend when it hits rocks or other debris in the water while the boat is in motion.

Accordingly, it is an object of the present invention to provide a livewell circulation apparatus which allows the circulation of fresh water through a boat's livewell system while the boat is underway or not underway.

Another object of the present invention is to provide a livewell circulating apparatus which allows the aeration of a boats livewell system while the boat is underway or not underway.

It is yet another object of the present invention to provide a livewell circulation system which, through a scooping action, causes water to be forced through the livewell system and carried up through the hose and pump apparatus to the livewell.

It is a further object of the present invention to provide a livewell circulation system which maintains a constant supply of fresh water to the livewell while the boat is underway.

Another further object of the present invention is to provide a livewell circulation system which eliminates the need for the recirculation pumps previously necessary and used to recirculate stale water in conventional livewell systems.

It is another object of the present invention to provide a livewell circulation system which reduces excessive boat weight and battery drain which is caused by stale water recirculation systems.

It is still another object of the present invention to provide a livewell circulation apparatus which will not cause excessive drag on the boat while the boat is in motion.

Other objects, features and advantages of the Present invention will become apparent from the following description when taken in conjunction with the accompanying drawings wherein like characters of reference designate corresponding parts throughout the several views.

BRIEF DESCRIPTION OF THE DRAWINGS

FIG. 6(*b*) is a plan view, partly in section, of the present invention with the pressure valve fully closed.

DESCRIPTION OF THE PREFERRED EMBODIMENTS

Figure 1:
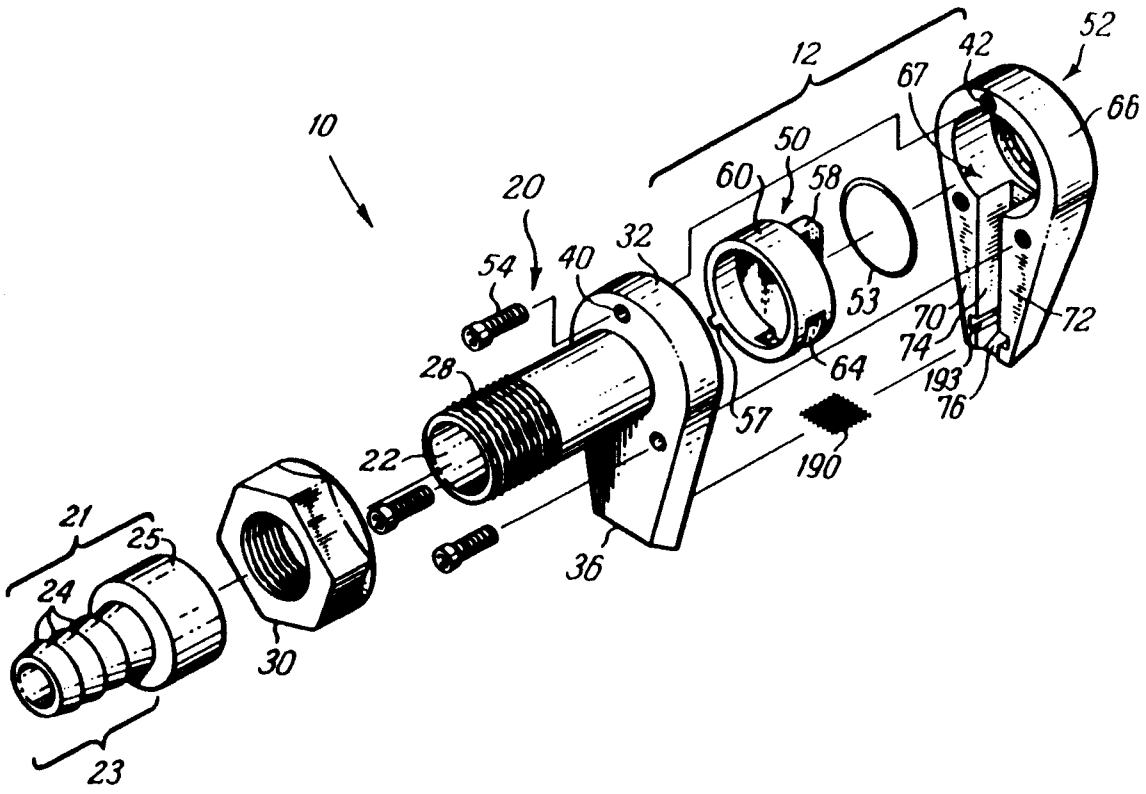
FIG. 1 is an exploded view of the thru-transom configuration of the present invention.
Figure 2:
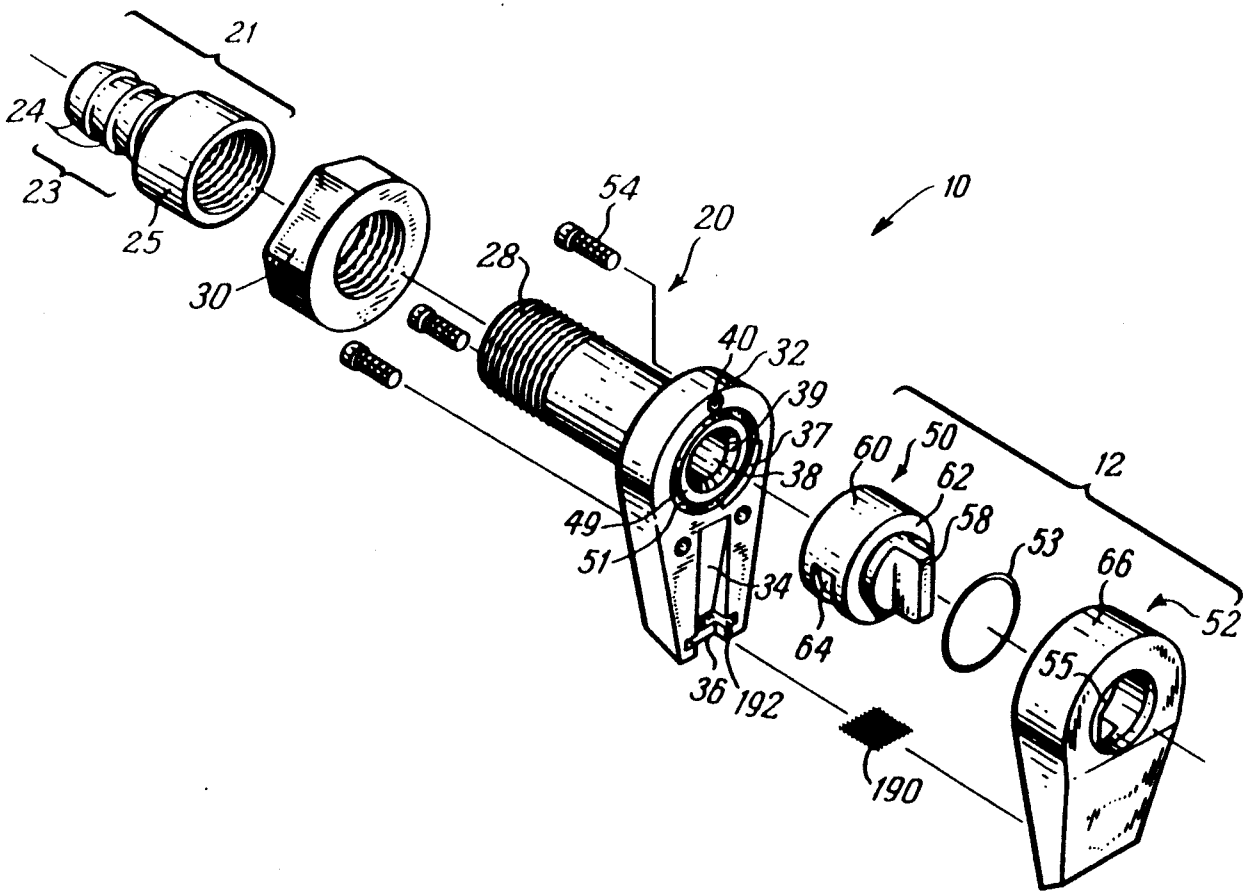
FIG. 2 is a reverse angle exploded view of the thru-transom configuration of the present invention.
Figure 3:
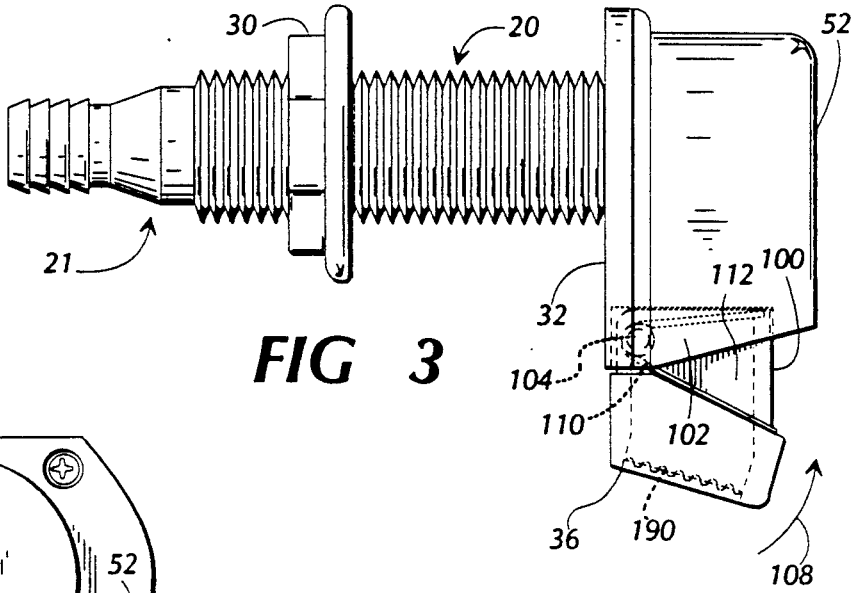
FIG. 3 is a side view of the present invention showing the pivotally mounted scoop.
Figure 4:
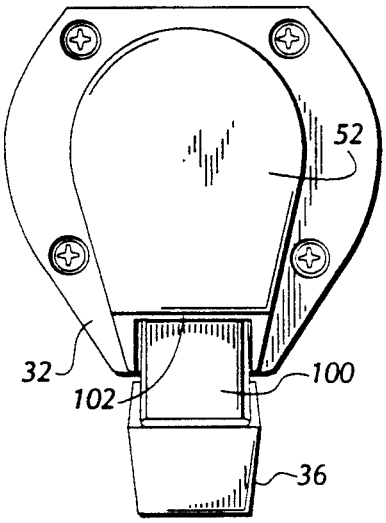
FIG. 4 is a rear view of the present invention as shown in FIG. 3 without a valve adjustment.
Figure 5:
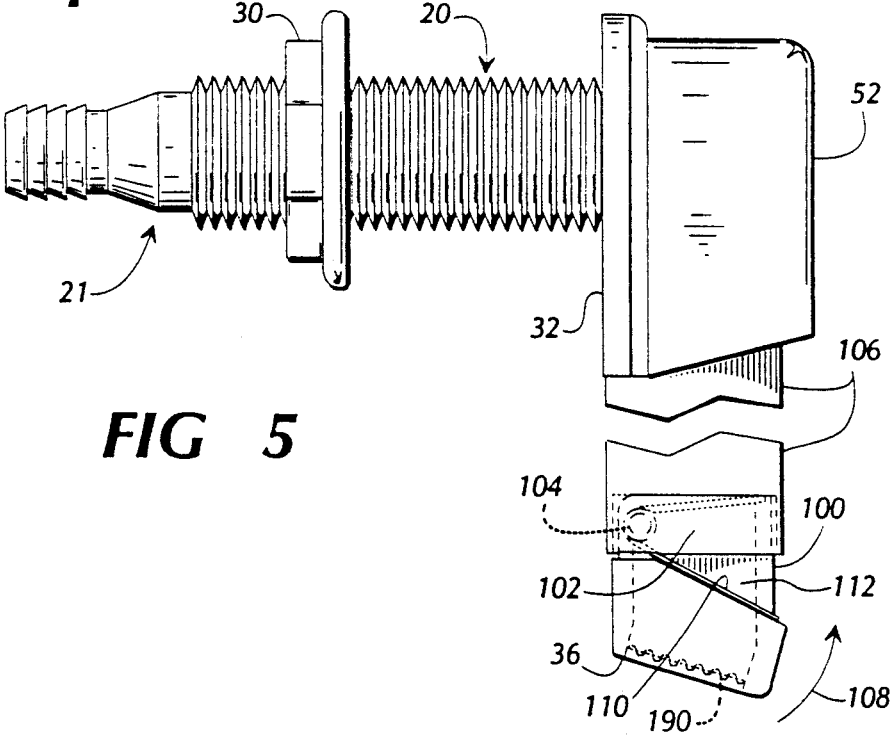
FIG. 5 is a side view of the present invention showing an extendable pivotally mounted scoop.
Figure 6A:
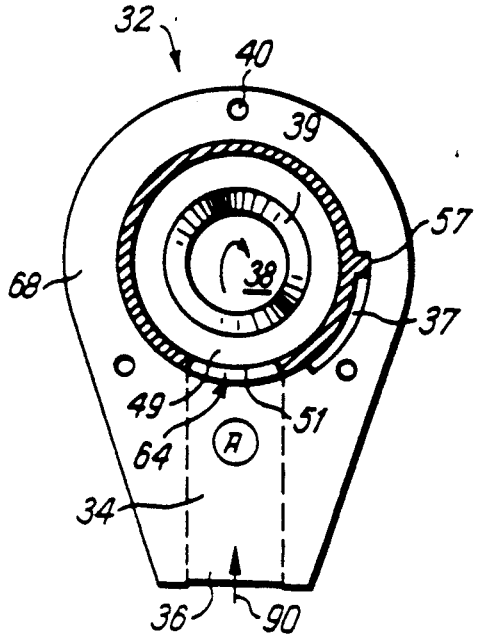
FIG. 6(*a*) is a plan view, partly in section, of the present invention with the pressure valve fully open.
Figure 6B:
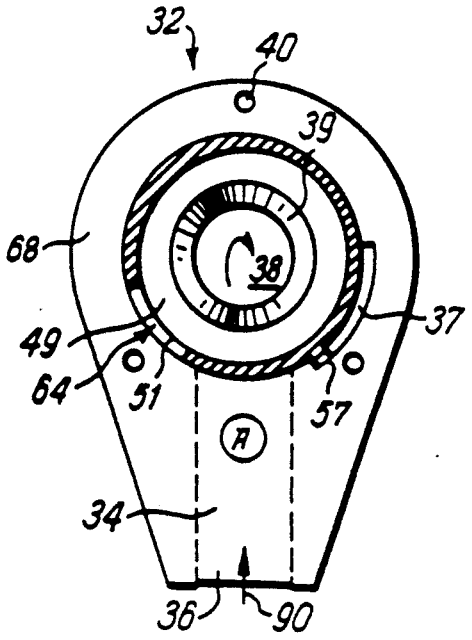

Referring to the embodiments chosen for the purpose of illustrating the present invention, FIGS. 1 and 2 depict the thru-transom configuration 10 of the present invention including a pressure valve assembly 12. FIGS. 3 and 4 depict the thru-transom configuration of the invention with the pivotally mounted scoop. FIG. 5 depicts the configuration of the invention with an extendable pivotally mounted scoop. FIGS. 6(*a–b*) show the operation of the basic configuration when the pressure valve is in various operating configurations. The thru-transom embodiment is attached securely to the rear transom of a boat.

Referring now to FIGS. 1 and 2, the thru-transom intake 20 is a generally tubular cylindrical pipe-like component having a generally tubular smooth interior wall 22. The first end of the intake 20 incorporates a conventional spiral screw thread 28 located on the outside surface of the intake 20. Screw thread 28 is used to engage mount nut 30 and adaptor 21 as more fully described below.

Integrally attached to the second, distal end of the intake 20 is a broadened flattened mounting plate 32. Mounting Plate 32 is a generally solid filled in horseshoe-shaped structure with the curved "front" portion of the horseshoe defining the top of mounting plate 32 and the flat "rear" portion of the horseshoe defining the bottom of the mounting plate 32. The plane of mounting Plate 32 is generally normal to the axis of the thru-transom intake 20. Mounting plate 32 further comprises mounting plate water intake channel 34 which is formed into the face of mounting plate 32 distal from the screw thread 28 and which extends from the bottom of the mounting plate where scoop mouth 36 is located almost to thru-transom intake port 38, which is a generally circular funnel-shaped opening through the plane of the mounting plate 32. Intake port 38 provides access through the mounting plate 32 to the interior of the intake 20, that is, to the smooth interior surface 22.

Mounting plate water intake channel 34 extends from the lower end of mounting plate 32 in a generally upwards direction and terminates just below thru-transom intake port 38. The entrance to the water intake channel 34 at the lower end of mounting plate 32 defines the scoop mouth 36. The scoop mouth 36 extends into the water and either forces water into the water intake channel 34 when the boat is moving or allows water to be pulled through scoop mount 36 when the boat is stationary. Channel 34 is generally rectangular in geometry relative to a plane parallel to the general plane of mounting plate 32; however, this geometry is unimportant as long as channel 34 effects its purpose of allowing fresh water to flow along channel 34 to pressure valve 50. Channel 34 generally narrows in depth along its length, being deepest at mouth 36 and becoming shallower as it nears intake port 38; however this geometry, too, is unimportant and the depth of channel 34 may remain constant along its length. Thru-transom intake port 38 is generally a circular funnel-shaped opening extending through mounting plate 32 into the interior of intake 20. Intake port 38 also has various seats, steps or tracks more fully described below.

Formed into the face of mounting plate 32 circumferential to intake port 38 is pressure valve track 51, which is a generally circular channel cut into the face of the mounting plate 32 on the same surface of the mounting plate 32 as the channel 34. Pressure valve track 51 is concentric with and radially disposed around intake port 38 and is cut to a depth into mounting plate 32 face suitable for allowing pressure valve 50 both to rotatably fit within track 51 and to prevent entering fresh water from seeping around pressure valve 50 while seated in track 51 and into the intake port 38. In other words, when pressure valve 50 is seated in track 51, fresh water entering the invention will not seep between pressure valve 50 and track 51 into intake port 38, but will either flow through valve slot 64, if open, into intake port 38, or be prevented from entering intake port 38 in valve slot 64 is closed, as described more fully below. Optionally, pressure valve track ridge 49 can be located between Pressure valve track 51 and intake port 38 to provide additional support for the pressure valve 50 and additional sealing from water seepage.

Also formed into the face of mounting plate 32 is valve stop channel 37, which is a generally arc shaped channel cut into the face of the mounting plate 32 on the same surface of the mounting plate 32 as the channel 34. Valve stop channel 37 is radially disposed around and contiguous to pressure valve track 51 and is cut to a depth into mounting plate 32 face suitable for allowing the pressure valve stop 57 to communicate and act in concert with the channel 37. In the embodiment without an auxiliary side intake channel 68, the arc of valve stop channel 37 extends for a distance of approximately the width of water intake channel 74, allowing the pressure valve 50 to rotate a set distance within the pressure valve housing 52. The specific purpose and operation of the valve stop channel 37 and the valve stop 57 is described more fully below.

Thru-transom intake 20 is mounted onto the transom of a boat by inserting the generally tubular cylindrical pipe-like portion of the intake 20, defined on the outside surface by spiral thread 28, through a pre-drilled hole through the transom. The hole must be drilled such that when the intake 20 is inserted fully, mounting plate 32 will contact flushly the transom and the mounting plate scoop mouth 36 will extend somewhat below the plane of the bottom of the boat. Intake 20 is secured on to the transom by using mount nut 30 by screwing mount nut 30 onto screw threads 28 until mount nut 30 contacts the interior wall of transom.

Valve assembly 12, as depicted in exploded view in FIGS. 1 and 2, and in actual operational configurations in FIG. 6, comprises pressure valve 50, pressure valve housing 52, and optional pressure valve seal or "O"-ring 53. Valve assembly 12 is mounted on the thru-transom unit 10 by conventional mounting means such as mounting screws 54 extending through screw holes 40 into mounting screw receptacles 42.

Pressure valve 50 has a geometry similar to a hollow cylindrical pipe or tube with a first open end and a second closed end, or a typical cylindrical can with a first open end and a second closed end, and a cylindrical sidewall 60. Pressure valve adjustment handle 58 is a generally rectangular, planar component located generally across and integrally attached to the diameter of the outside surface of the second closed end of pressure valve 50. Handle 58 generally extends from the flush surface 62 of the second closed end of pressure valve a distance sufficient to extend through valve adjustment handle set hole 55, described more fully below. Alternatively, handle 58 may be replaced with a slot, for adjustment with a screw-driver.

Valve slot 64 extends through the sidewall 60 from outside to inside allowing communication from the outside of the valve 50 to the inside of the valve 50 and extends a certain distance radially around the sidewall 60. Generally, valve slot 64 is of approximately the same length of the width of the water intake channel 74 described more fully below.

Pressure valve 50 further comprises a valve stop 57 which extends radially from the sidewall 60 at the first open end of the pressure valve 50. Valve stop 57 is a generally cubic protuberance which is located on the outside circumference of the sidewall 60 and, when communicating and acting in concert with valve stop channel 37, acts to control the rotation of the pressure valve 50 within the invention.

Pressure valve 50 is manufactured to be of such a size that it will fit snuggly in valve cavity 67 and in pressure valve track 51. An "O"-ring 53 generally is placed between valve 50 and cavity inner wall 67 to both seal the valve adjustment handle set hole 55 so water will not seep in or out, and to provide pressure on the valve 50 so that it remains in pressure valve track 51. Optional "O"-ring seat grooves (not shown) may be grooved into either or both valve 50 and cavity inner wall 67 to prevent "O"-ring 51 from shifting within the valve assembly. If "O"-ring 51 is not used, valve 50 should be manufactured to be of such a size that it will fit snuggly in valve cavity 67 with valve side wall 60 frictionally engaging valve cavity inner wall 67. Pressure valve 50 should be large enough that when valve side wall 60 frictionally engages cavity inner wall 67, pressure valve 50 will not rotate within valve cavity 67 unless forced to do so by an external force applied to the valve at valve adjustment handle 58.

Pressure valve housing 52 is a generally solid horseshoe-shaped component with the curved "front" part of the horseshoe corresponding to the top of the pressure valve housing 52 and the flat "rear" part of the horseshoe corresponding to the bottom of the pressure valve housing 52. Pressure valve housing 52 has housing sidewall 66 extending normal to the horseshoe-shaped plane defining a generally circular cavity 67 into which pressure valve 50 fits. This circular cavity 67 is located toward the top of the pressure valve housing 52 and is approximately equal in diameter to the outer diameter of flush surface 62 and approximately equal in depth to the height of the pressure valve side wall 60. Pressure valve housing 52 also comprises a valve adjustment handle set hole 55 extending through the housing 52 from the interior of the cavity through inner wall 67 to the outside. Pressure valve housing 52 further comprises first channel wall 70 and second channel wall 72 extending along the lower outside edge portions of the pressure valve housing 52 which define intake channel 74 and intake scoop 76. First and second channel walls 70, 72 extend from and are integrally attached to the lower ends of housing side wall 66.

Valve adjustment handle set hole 55 is a circular opening in the rear wall of pressure valve housing 52 and is concentric with cavity 67. Valve adjustment handle set hole 55 is of a diameter large enough that valve adjustment handle 58 extends through set hole 55 such that it can be grasped and rotated by the user, but of a diameter small enough such that pressure valve 50 will not fit through set hole 55.

In operation, pressure valve 50 is inserted within pressure valve housing 52 such that valve adjustment handle 58 extends through valve adjustment handle set hole 55. An "O"-ring 53 may be used between valve 50 and the inner cavity 67 of pressure valve housing 52 both to provide pressure on the pressure valve 50 so that it will not rotate unless urged to do so by the user and to create a seal between the pressure valve 50 and the rear surface of the pressure valve housing 52 to prevent fresh water entering the invention by seeping between the pressure valve 50 and the pressure valve housing 52 from set hole 55. To adjust valve 50, one rotates valve adjustment knob 58 until the desired setting is achieved. Valve stop 57 prevents valve 50 from rotating beyond the set arc defined by channel 37.

Intake channel 74 is a generally rectangular cubic channel extending from intake scoop 76 to pressure cavity 67. Intake scoop 76 is located on the lower edge of pressure valve housing 52 and defines the lower end of intake channel 74. The lower edge of pressure valve housing 52 may angle inward towards intake channel 74 to form intake scoop 76. Intake channel 74 is generally rectangular in a plane relative to the primary plane of pressure valve housing 52 and also is rectangular in cross-section relative to a plane normal to the primary plane of pressure valve housing 52. Intake channel 74 functions in conjunction with intake channel 34 to direct fresh water scooped up from the body of water by intake scoop 76 functioning in conjunction with scoop mouth 36 to pressure valve 50.

Pressure valve 50 is placed in pressure valve housing cavity 67. As pressure valve 50 is rotated in valve cavity 67 by rotating adjustment knob 58 clockwise or counterclockwise, the valve slot 64 also rotates in relation to the upper end of intake channels 34 and 74, thus "opening" and "closing" pressure valve 50. Pressure valve 50 may be rotated such that valve slot corresponds to the upper end of intake channels 34 and 74 allowing water to flow from the intake channels 34 and 74 through the valve slot 64 and into the interior of the pressure valve 50. From there, the water flows through the intake port 38 and into the livewell circulation system. This is the fully opened position as shown in FIG. 6(*a*). Pressure valve 50 also may be rotated such that valve slot 64 does not correspond with the upper end of intake channels 34 and 74 and water is prevented from entering the interior of pressure valve 50 and cannot enter the livewell circulation system. This is the fully closed position as represented in FIG. 6(*b*). Pressure valve 50 also may be rotated to any position between the fully open and the fully closed position to create a desired water flow rate through the pressure valve 50 and into the livewell circulation system. As mentioned above, the distance the pressure valve 50 is allowed to rotate is fixed by the valve stop 57 acting in concert with the valve stop channel 37.

The pressure valve housing assembly 12 including the pressure valve 50 is mounted onto the thru-transom intake 20 using mounting screws 54. Screw holes 40 on thru-transom intake 20 are provided for mounting the pressure valve assembly 12 on to the intakes 20. Corresponding screw receptacles 42 are located on the pressure valve housing 52 opposite screw holes 40. Mounting screws 54 are inserted through screw holes 40 and are secured into screw threads located internally in screw receptacles 42, thus securing pressure valve assembly 12 onto the intake unit 20.

When pressure valve assembly 12 is mounted correctly onto intake unit 20, pressure valve 50 is located immediately opposite intake port 38, pressure valve housing intake channel 74 is located directly opposite mounting plate intake slot 34, and intake scoop 76 is located directly opposite mounting plate intake scoop 36, thus forming an enclosed fresh water intake channel running between thru-transom intake 20 and Pressure valve housing 52 and from the fresh water intake defined by intake scoop 76 in cooperation with mounting plate intake scoop 36 to slot 64 on pressure valve 50. The first open end of the sidewall 60 fits within track 51 and valve stop 57 fits within valve stop channel 37.

The invention may further comprise water intake screen 190 which is attached to the unit by inserting intake screen 190 in a screen slot 192 on the transom mount 20 and a corresponding second screen slot 193 on pressure valve housing 52. Screen slot 192 is located at the lower end or mouth of the intake channel 34 of the transom mount 20, opposite intake scoop 76 on the pressure valve housing 52, and is a horizontal indentation or cut into the transom mount 20. Second screen slot 193 is located at the lower end of the intake scoop 76 on the pressure valve housing 52 and is a horizontal indentation or cut into the pressure valve housing 52, which is generally opposite to screen slot 192 across the intake channel 34 when the pressure valve housing 52 is attached to the transom mount 20. The screen slot 192 is approximately one-sixteenth of an inch (1/16") from the mouth of the intake channel 34 and is approximately one-sixteenth of an inch (1/16") deep, however both of these measurements are unimportant as long as the screen slot 192 is far enough from the mouth of the channel 34 so the ledge created by the separation between the screen slot and the mouth of the intake channel 34 is large enough to support the intake screen 190 and the screen slot 192 is cut deep enough into the transom unit 20 to hold and support the intake screen 190 within the screen slot 192.

The second screen slot 193 also is approximately one-sixteenth of an inch (1/16") from the mouth of the intake scoop 76 and is approximately one-sixteenth of an inch (1/16") deep, however both of these measurements are unimportant as long as the second screen slot 193 is far enough from the mouth of the intake channel 74 so the ledge created by the separation between the second screen slot and the mouth of the intake channel 74 is large enough to support the intake screen 190 and the screen slot 193 is cut deep enough into the transom unit 20 to hold and support the intake screen 190 within the screen slot 193. The screen slot 192 and the second screen slot 193 act in concert and cooperate with each other to hold the intake screen 190 in position at the mouth of the combined intake channel 34, 74.

Intake screen 190 may be any conventional mesh and acts to cover entirely the fresh water intake created by the mouth of the channel 34 acting in cooperation with the mouth of the intake channel 74 when the pressure valve housing 52 is attached to the transom mount 20. Although screen 190 is optional, it is highly desired as the main function of the intake screen 190 is to prevent debris contained in the fresh water from entering the unit and, subsequently, entering the livewell circulation system.

Referring now to FIG. 3, the embodiment comprising the pivotally mounted scoop 36 is shown in more detail. Rather than being an integral extension of the Pressure valve housing 52, a separate, rotatable scoop 36 is provided. Scoop 36 has the same general shape as discussed above, but also comprises scoop neck 100. Intake channel 34 is broadened somewhat at its lower end so as to accomodate scoop neck 100 in pivot scoop slot 102. Enough extra space is left in intake channel 34 such that when scoop 36 pivots in the direction indicated by directional arrow 108, scoop neck will rotate within pivot slot 102. In this manner, if scoop 36 encounters an underwater hazard, such as a rock or a tree limb, it will be forced to rotate in the direction of arrow 108, and will do so freely as scoop neck 100 rotates into pivot slot 102. Return spring 110 forces scoop 36 back into its intake Position after the hazard has been cleared. FIG. 4 illustrates the embodiment shown in FIG. 3 viewing from the rear of the boat.

In more detail, intake channel 34 on mounting plate 32, and intake channel 74 on valve housing 52, no longer terminate in scoop 36, as disclosed in relation to FIGS. 1 and 2. Instead, intake channel 34 and intake channel 74 terminate in pivot slot 102. Structurally, pivot slot 102 merely is a widening of the lower end of intake channel 33 and intake channel 74 such that scoop neck 100 will have adequate room to rotate without interference from the outer walls of intake channel 34 and intake channel 74. In addition, the amount intake channel 34 and intake channel 74 are widened to create pivot scoop slot 102 should be enough such that scoop intake 112 has approximately the same dimension as the channel created by the combination of intake channel 34 and intake channel 74 when valve housing 52 is mounted to mounting plate 32. Thus, the combination of scoop channel 112 and the channel formed by the combination of intake channel 34 and intake channel 74 should be a generally continuous channel from scoop 36 to circular cavity 67.

Scoop 36 is rotatably mounted to the device 10 by pins 104. Semi-circular slots are formed on the face of mounting plate 32 and the channel wall 70, 72 of valve housing 52. The semi-circular slots cooperate with each other when valve housing 52 is mounted onto mounting plate 32 such that a generally circular in diameter slot is formed on each side of the combined intake channel formed by intake channel 34 and intake channel 74. Pins 104 fit within these slots such that scoop 36 is rotatably mounted to the device between valve housing 52 and mounting plate 32. Return spring 110 typically is a high tension steel, but may be any material which has return spring capabilities. As scoop 36 is forced backwards such that scoop neck 100 rotates into pivot slot 102, return spring 110 compresses. Once the force on scoop 36 is released, return spring 110 will force scoop 36 back to its intake position such that scoop neck 100 will rotate out of pivot slot 102. It should be noted that a portion of scoop neck 100 always remains within pivot slot 102 to prevent water entering scoop 36 from escaping from the combination intake channel 34, 74, 112.

Referring now to FIG. 5, the embodiment showing the extendable scoop is shown in greater detail. The scoop 36 may or may not be pivotally mounted, and can be as the scoop shown in FIGS. 1 and 2, or the scoop shown in FIGS. 3 and 4. In the extendable embodiment shown in FIG. 5, the lower part of the mounting plate 32 has extension 106 allowing the device 10 to be mounted anywhere on the transom of the boat, and the scoop to extend down to the level of the bottom of the boat. Typically, extension 106 merely is a hollow extension channel connecting intake channel 112 from the scoop 36 to the mounting plate 32 such that intake channel 112 will cooperate with intake channel 34. Alternatively, extension 106 may be of an accordian or telescoping design such that it may be adjusted upward or downward as necessary for the particular boat, while the mounting plate 32 remains stationary on the boat.

In the extendable version, extension 106 generally acts as an extension of intake channel 34 and structurally is a generally hollow tube having a rectangular cross section. When extension 106 is used, intake channel 74 must be altered so that it is wide enough and deep enough to surround extension 106 when valve housing 52 is mounted onto mounting plate 32. The widening of intake channel 74 can be structurally similar to pivot slot 102 such that the lower end of intake channel 74 is widened to fit over the outer perimeter of extension 106, while the remainder of intake channel 74 cooperates with intake channel 34 to form a channel generally corresponding with the inner perimeter of intake channel 112. In this manner, water flowing through intake channel 112 will flow into the combined channel created by intake channel 34 and intake channel 74 when valve housing 52 is mounted onto mounting plate 32. In its telescoping or accordian alternative embodiment, any of the known manners of creating a telescoping or accordian unit may be employed to extension 106. In this manner, the device 10 may be mounted onto the boat, and the lower portion of the device, including scoop 36, may be lowered or raised to the suitable position where scoop 36 is just below the bottom of the boat by extending or retracting the telescoping or accordian portion. Once the scoop 36 is in the proper position, the lower portion of the device 10, including scoop 36, can then be secured to the transom of the boat using conventional mounting means such as brackets or optional screw eyelets attached to extension 106.

FIG. 6 is a diagram of the pressure valve 50 and transom mount 20 of the present invention. The two (2) views shown in FIG. 6 also are for example purposes only and it should be noted that the pressure valve 50 may be set in any position between fully open and fully closed as desired to achieve the desired pressure and water flow.

FIG. 6(*a*) shows the pressure valve 50 in a fully open mode wherein water flow 90, which is scooped from the body of water, travels up intake channel 34, 74 into pressure valve 50. FIG. 6(*a*) represents nearly full pressure and water flow to the pump. With the pressure valve 50 set in this position when the boat is running or at idle, the water flow through the invention to the livewell circulation system is near its greatest. FIG. 6(*b*) shows the pressure valve 50 in its fully closed configuration. In this configuration, there is no water intake inflow through intake channel 34, 74. With the pressure valve set in this position when the boat is running or at idle, the flow of the water through the invention and into the livewell circulation system is minimal. When the boat is at idle, an auxiliary pump is used to pull water through the invention into the livewell circulation system.

In operation, the circulation apparatus of the present invention is designed to force fresh water to the livewell circulation system while the boat is underway and to allow the pumping of fresh water to the livewell circulation system when the boat is stationary. The circulation apparatus of the present invention must be mounted such that the fresh water scoop apparatus, defined by intake scoop 76 and mounting plate intake scoop 36, will catch water passing under the boat and direct the water through the intake channel system, defined by housing intake channel 74 and mounting plate intake channel 34, into the pressure valve 50 and then through intake port 38 and into the livewell circulation system.

The thru-transom intake 20 is designed to compliment existing livewell circulation systems. For instance, the adaptor 21, described below, is designed to accept a ⅝ inch diameter hose on radial grooves 24, which hose would lead to a conventional pump to circulate the fresh water through the livewell circulation system. However, the adaptor need not be used, allowing the user to connect the threaded portion 28 of the thru-transom intake 20 to a conventional threaded hose or coupler via a conventional threaded coupling or elbow.

Adaptor 21 is used to connect the invention to the typical livewell circulation system. Adaptor 21 comprises hose connector 23, radial grooves 24 and screw coupler 25. Hose connector 23 is of a conventional nipple design and is inserted into the interior of a hose (not shown) leading to the livewell circulation system (not shown). Radial groves 24 are used to frictionally contact the inner surface of the suitable hose connected to the remainder of the livewell circulation system. Radial grooves 24 extend for a distance along the outer surface of the adaptor 21 suitable for sufficient contact with the hose such that hose will frictionally remain on the adaptor 21, or, alternatively, a conventional hose clamp may be used to accomplish the same purpose. Coupler 25 is a generally cylindrical hollow structure integrally attached to and coaxial with the end of the hose connector 23. The interior of coupler 25 has a conventional spiral screw thread which cooperates with the screw thread 28 of the thru-transom intake 20. When the thru-transom intake 20 is mounted on the transom 16, adaptor 21 is screwed onto the end of the intake 20 which extends into the interior of the boat, and the hose is attached to the hose connector 23 so as to allow the invention to communicate with the livewell circulation system.

After the circulation apparatus of the present invention is mounted as discussed previously, the user must set the flow of water through the system by adjusting the pressure valve 50. This is accomplished by rotating the pressure valve 50 to the desired position by turning the valve handle 58. The pressure valve 50 is held in that position by pressure created by the "O"-ring 51, if used, and by friction between the pressure valve 50 and the pressure valve housing 52.

Once the pressure valve 50 has been set at an initial position by rotating valve adjustment handle 58, a test run in the boat should be made with the boat at top speed. The user should note visually the flow of water through the system into the livewell. If too much water is flowing through the system, the user should adjust the pressure valve 50 by turning the valve handle 58 an incremental amount clockwise so that pressure valve 50 is now in a new position. If too little water is flowing through the system and into the livewell, the pressure valve handle 58 should be rotated counterclockwise an incremental amount. Once the pressure valve 50 has been readjusted, another test run should be made with the boat at top speed. The user again should check visually the amount of water flowing through the circulation system and into the livewell and repeat the above procedure until the desired rate of water flow into the livewell system is accomplished.

It will be obvious to those skilled in the art that many variations may be made in the embodiment herein chosen for the purpose of illustrating the present invention, and full result may be had to the doctrine of equivalence without departing from the scope of the present invention as defined by the appended claims.

I claim:

1. An apparatus for collecting water and channeling it into a boat livewell system comprising scoop means, a housing, a valve, and a connecting means; wherein said scoop means is pivotally attached to housing, said housing is secured to said connecting means, said valve is located in said housing between said scoop means and said connecting means for controlling the amount of water channeled into the boat livewell system, and said connecting means connects said housing said scoop means to the boat livewell system.

2. The apparatus as defined in claim 1, wherein said valve is rotatably secured within said housing.

3. The apparatus as defined in claim 2 further comprising a screen located on said scoop means.

4. The apparatus as defined in claim 2, wherein said valve is rotatably adjustable within said housing for controlling the amount of water channeled from said scoop mans through said valve into the boat livewell system.

5. The apparatus as defined in claim 1, wherein said connecting means comprises generally a tubular component having a proximal and distal end and an exterior surface, said distal end being capable of being releasably secured to a boat livewell system and said proximal end being capable of being releasably secured to the transom of a boat, said tubular component having a sufficiently long length to extend through the transom of the boat.

6. The apparatus as defined in claim 1, wherein said connecting means comprises a mounting housing having an inner surface, an outer surface and side wall defining the perimeter of the mounting housing, wherein said inner surface is adapted to fit over a preexisting intake port on the transom of a boat and said outer surface providing a mounting surface for said housing.

7. The apparatus as defined in claim 1, wherein said scoop means extends below the waterline of the boat.

8. The apparatus as defined in claim 1 further comprising a secondary intake slot means located on said housing.

9. An apparatus for collecting water and channeling it into a boat livewell system comprising scoop means, a housing, a valve, and a connecting means; wherein said scoop means is adjustably attached to said housing, said housing is secured to said connecting means, said valve is located in said housing between said scoop means and said connecting means for controlling the amount of water channeled into the boat livewell system, and said connecting means connects said housing and said scoop means to the boat livewell system.

10. The apparatus as defied in claim 9, wherein said valve is rotatably secured within said housing.

11. The apparatus as defined in claim 10 further comprising a screen located on said scoop means.

12. The apparatus as defined in claim 10, wherein said valve is rotatably adjustable within said housing for controlling the amount of water channelled from said scoop mans through said valve into the boat livewell system.

13. The apparatus as defined in claim 9, wherein said connecting means comprises generally a tubular component having a proximal and distal end and an exterior surface, said distal end being capable of being releasably secured to a boat livewell system and said proximal end being capable of being releasably secured to the transom of a boat, said tubular component having a sufficiently long length to extend through the transom of the boat.

14. The apparatus as defined in claim 9, wherein said connecting means comprises a mounting housing having an inner surface, an outer surface and side wall defining the perimeter of the mounting housing, wherein said inner surface is adapted to fit over a preexisting intake port on the transom of a boat and said outer surface providing a mounting surface for said housing.

15. The apparatus as defined in claim 9, wherein said scoop means extends below the waterline of the boat.

16. The apparatus as defined in claim 9 further comprising a secondary intake slot means located on said housing.

* * * * *